US007497670B2

(12) United States Patent
Murata

(10) Patent No.: US 7,497,670 B2
(45) Date of Patent: Mar. 3, 2009

(54) DUAL DIAPHRAGM TRANSFER PUMP

(75) Inventor: Shigeru Murata, Tokyo (JP)

(73) Assignee: Yamada Corporation, Tokyo (JP)

( * ) Notice: Subject to any disclaimer, the term of this patent is extended or adjusted under 35 U.S.C. 154(b) by 688 days.

(21) Appl. No.: 10/728,753

(22) Filed: Dec. 8, 2003

(65) Prior Publication Data

US 2004/0197211 A1 Oct. 7, 2004

(30) Foreign Application Priority Data

Apr. 3, 2003 (JP) ..... 2003-100253

(51) Int. Cl.
*F04B 43/06* (2006.01)
*F04B 43/073* (2006.01)

(52) U.S. Cl. ..... 417/395; 417/397; 417/534; 417/535; 417/536; 92/98 R

(58) Field of Classification Search ..... 417/395, 417/397, 534, 535, 536; 92/98 R
See application file for complete search history.

(56) References Cited

U.S. PATENT DOCUMENTS 2,748,797 A * 6/1956 Heizer et al. ..... 137/510
5,261,798 A * 11/1993 Budde ..... 417/393
5,558,506 A * 9/1996 Simmons et al. ..... 417/393
5,749,690 A * 5/1998 Kutz ..... 411/431
6,106,246 A * 8/2000 Steck et al. ..... 417/395
6,402,486 B1 * 6/2002 Steck et al. ..... 417/395
6,874,997 B2 * 4/2005 Watanabe et al. ..... 417/395
2002/0093144 A1 * 7/2002 Taga ..... 277/607
2003/0101865 A1 * 6/2003 Murata ..... 92/99

* cited by examiner

*Primary Examiner*—Devon C Kramer
*Assistant Examiner*—Leonard J Weinstein
(74) *Attorney, Agent, or Firm*—Wenderoth, Lind & Ponack, L.L.P.

(57) ABSTRACT

A reciprocating fluid transfer pump in which a pilot valve assembly block can be mounted to a main body block in a simple, easy and reliable manner. In the reciprocating fluid transfer pump, a fluid, which has been suctioned into a fluid delivering chamber (19), is discharged therefrom by causing an expanding and contracting action of a barrier membrane (6) which is attached to either end of a center rod (5). The center rod is capable of reciprocating with respect to the main body block (2). A peripheral portion of the barrier membrane (6) is clamped fixedly to the main body block (2) via a main ring (30), and a pilot valve assembly block (17) having an integrated pilot valve (16) for detecting the reciprocating motion of the center rod (5) is pressed against and thus fixedly secured to the main ring (30) via a sub ring (34).

7 Claims, 6 Drawing Sheets

DUAL DIAPHRAGM TRANSFER PUMP

BACKGROUND OF THE INVENTION

The present invention relates to an improvement in a reciprocating fluid transfer pump in which a once, having flown into a fluid delivering chamber, is discharged therefrom by expanding and contracting a diaphragm disposed at an end portion of a center rod capable of making a reciprocating movement relative to a main body block and defining the fluid delivering chamber and a driving chamber.

In a reciprocating fluid transfer pump as described in U.S. Pat. No. 6,106,246, there has been used a diaphragm-type pump comprising a center rod capable of being driven to make a reciprocating motion relative to a main body block, in which a pair of diaphragms is secured to both ends of said center rod such that each of said pair of diaphragms may be located in place within head space so as to separate it to define a fluid delivering chamber and a driving chamber respectively. When the center rod is to be driven toward one side, a driving fluid (e.g., a compressed air) is supplied into the driving chamber located in an other side, an opposite side of said one side, of the center rod so as to discharge a fluid in the fluid delivering chamber located in said other side, and at the same time, the fluid is suctioned into the fluid delivering chamber located in said one side of the center rod while allowing the driving fluid in the driving chamber located in said one side to be exhausted, and when the center rod is to be driven toward said other side, the driving fluid is supplied into the driving chamber located in said one side of the center rod so as to discharge the fluid in the fluid delivering chamber located in said one side, and at the same time, the fluid is suctioned into the fluid delivering chamber located in said other side of the center rod while allowing the driving fluid in the driving chamber located in said other side to be exhausted, so that the fluid may be transferred continuously through this reciprocating motion of the center rod.

In this regard, said diaphragm-type pump comprises a pilot valve assembly block and a change-over valve assembly block, both of which are mounted on a main body block of the pump, said pilot valve assembly block including a pilot valve integrated therein as one body for detecting reciprocating strokes of the center rod and said change-over valve assembly block including a change-over valve integrated therein as one body for switching flow channels of the driving fluid based on a detection signal from the pilot valve.

However, in mounting operation of these valve assembly blocks, respective ports of the pilot valve assembly block must be positioned in proper locations with respect to respective ports of the change-over valve assembly block so as to form the flow channels for the driving fluid, and consequently this requires a certain level of machining precision for positioning the pilot valve assembly block relative to the main body block as well as the assembling precision therebetween.

Some diaphragm-type pumping apparatuses have employed an alternative configuration in which a positioning operation of the pilot valve assembly block relative to the main body block is not required in assembling therebetween but tubes for defining the flow channels are used so as to connect respective ports of the change-over valve assembly block with respective ports of the pilot valve assembly block, but this type of pumping apparatus could also lead to such an unfavorable situation owing to the tubes being laid externally, that the tubes may cause an interference with other structures located in the peripheral regions of the apparatus, and that in case of breakage or disconnection of the tube, the driving fluid could be leaked out.

This type of pumping apparatus also suffers from another problem that since the position of respective ports of the pilot valve assembly block is not fixedly defined relative to the respective ports of the change-over valve assembly block, the assembling location of the incorporated tubes is changed occasionally, which could produce undesirable variations in the performance of the diaphragm pump.

The present invention has been made in the light of the circumstances as described above, and an object thereof is to provide a reciprocating fluid transfer pump having such a configuration in which a pilot valve assembly block can be mounted to a main body block in a simple and easy manner without requiring a particularly high level of machining precision for positioning the pilot valve assembly block relative to the main body block.

SUMMARY OF THE INVENTION

According to the present invention, there is provided a reciprocating fluid transfer pump in which a fluid, once having been auctioned into a fluid delivering chamber, is discharged by expanding and contracting a barrier membrane or a diaphragm attached to an end portion of a center rod capable of making a reciprocating movement relative to a main body block and defining said fluid delivering chamber and a driving chamber. The reciprocating fluid transfer pump being characterized in that a peripheral portion of said barrier membrane is clamped and thus secured to said main body block via a main ring and a sub ring, and a pilot valve assembly block having a pilot valve integrated therein as one body for detecting a reciprocating motion of said center rod is pressed against and thus secured to said main body block with the aid of said main ring and said sub ring.

According to one aspect of the present invention, there is provided a reciprocating fluid transfer pump in which a change-over valve assembly block having a change-over valve integrated therein as one body for switching movable directions of said center rod is secured fixedly to said main body block. The change-over valve assembly block and said pilot valve assembly block are interconnected via a piping block defining flow channels for connecting respective ports of the change-over valve with respective ports of the pilot valve.

According to another aspect of the present invention, there is provided a reciprocating fluid transfer pump in which said respective ports are connected to said respective flow channels of said piping block via connectors.

According to further aspect of the present invention, there is provided a reciprocating fluid transfer pump in which said piping block is secured fixedly to said main body block via said pilot valve assembly block.

Figure 1:
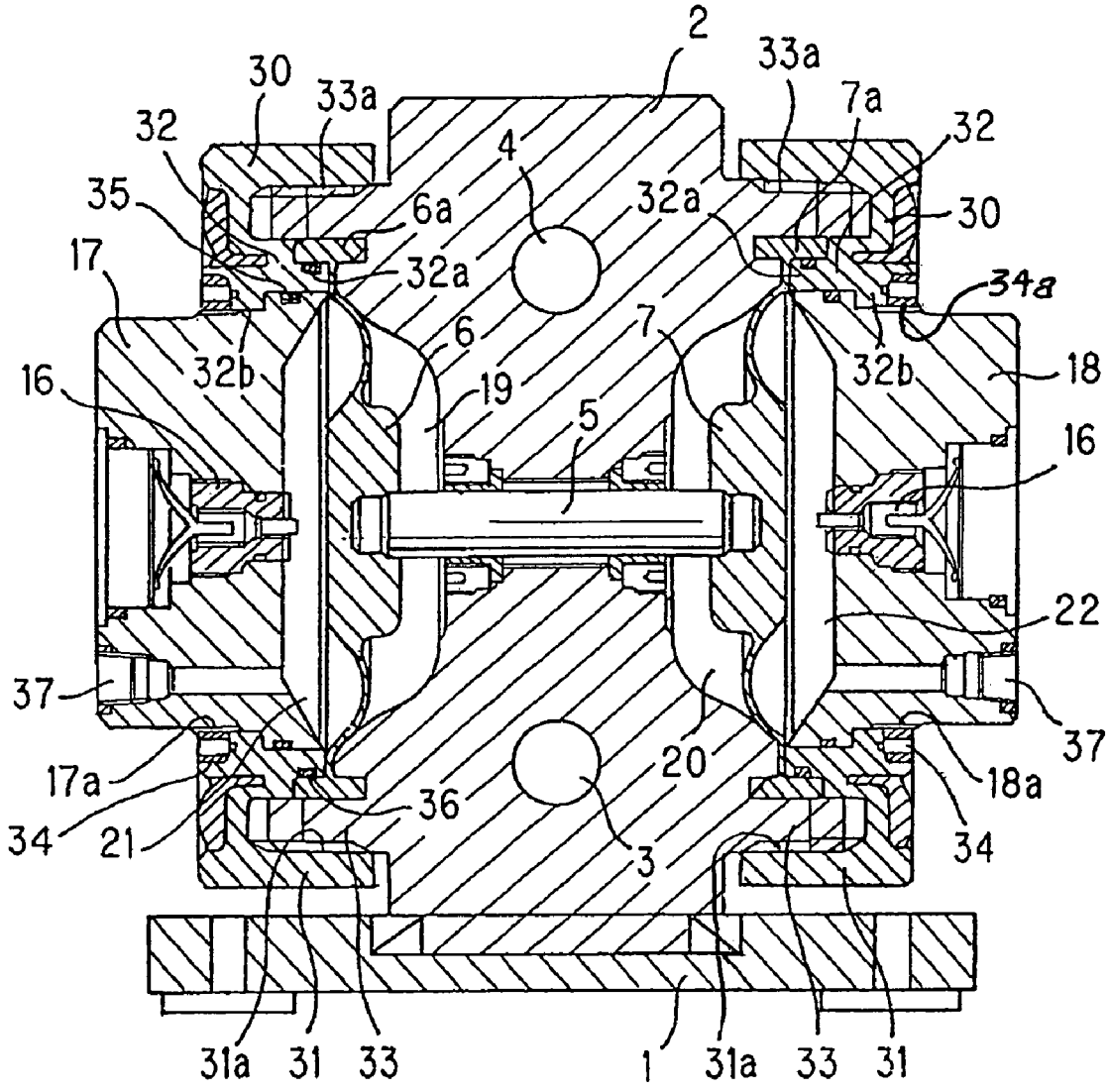
FIG. 1 is a sectional view of a diaphragm pump according to an embodiment of the present invention taken along the line A-A of FIG. 2.

In the drawing figures, reference numeral 2 designates a main body block; 5 a center rod; 6 and 7 barrier membranes (diaphragms); 16 a pilot valve; 17 and 18 pilot valve assembly blocks; 19 and 20 fluid delivering chambers; 21 and 22 driving chambers; 26 a piping block; 30 a main ring; and 34 a sub ring.

DETAILED DESCRIPTION OF THE INVENTION

Figure 2:
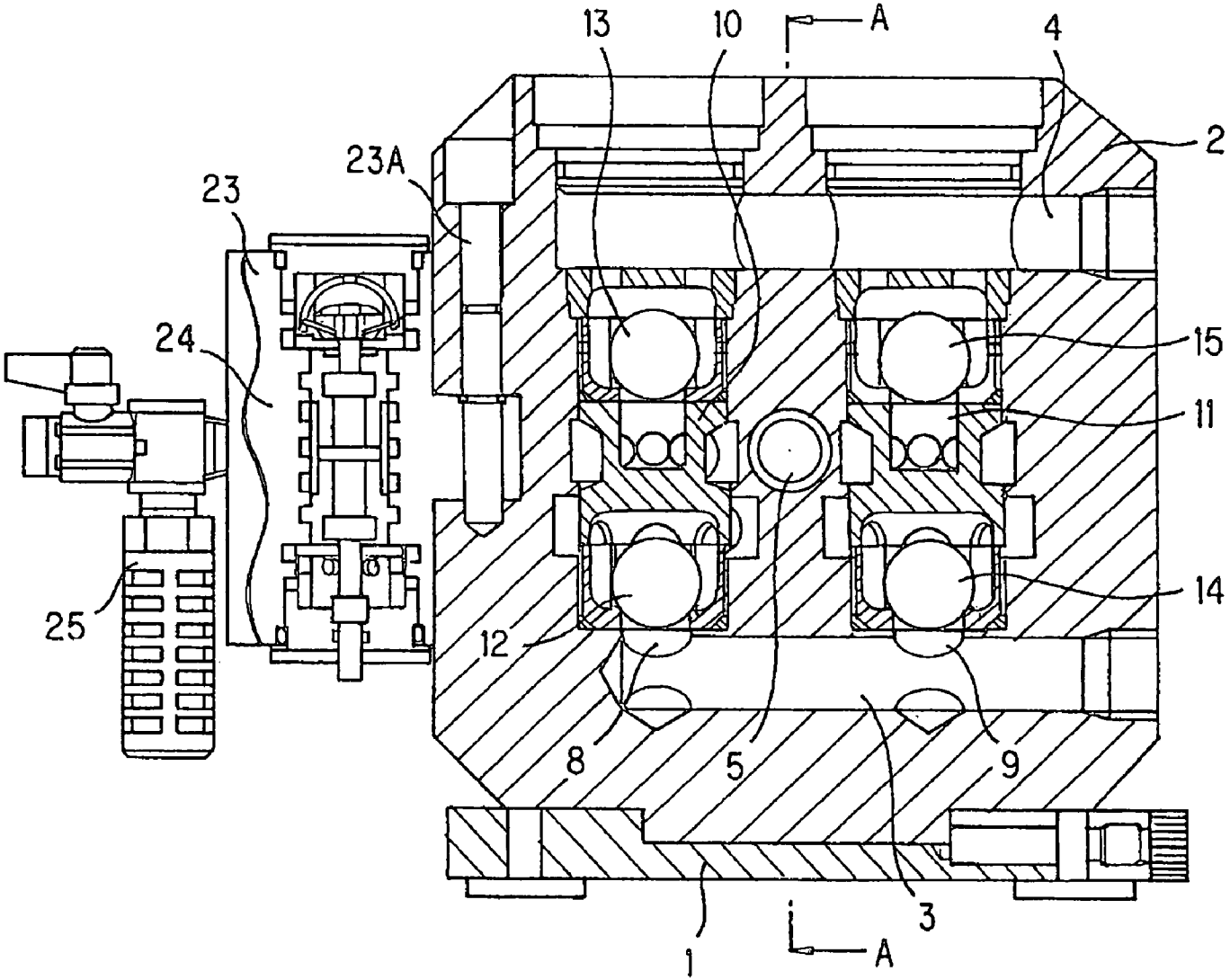
FIG. 2 is a sectional view of the diaphragm pump according to the embodiment of the present invention taken along the line B-B of FIG. 3.
Figure 3:
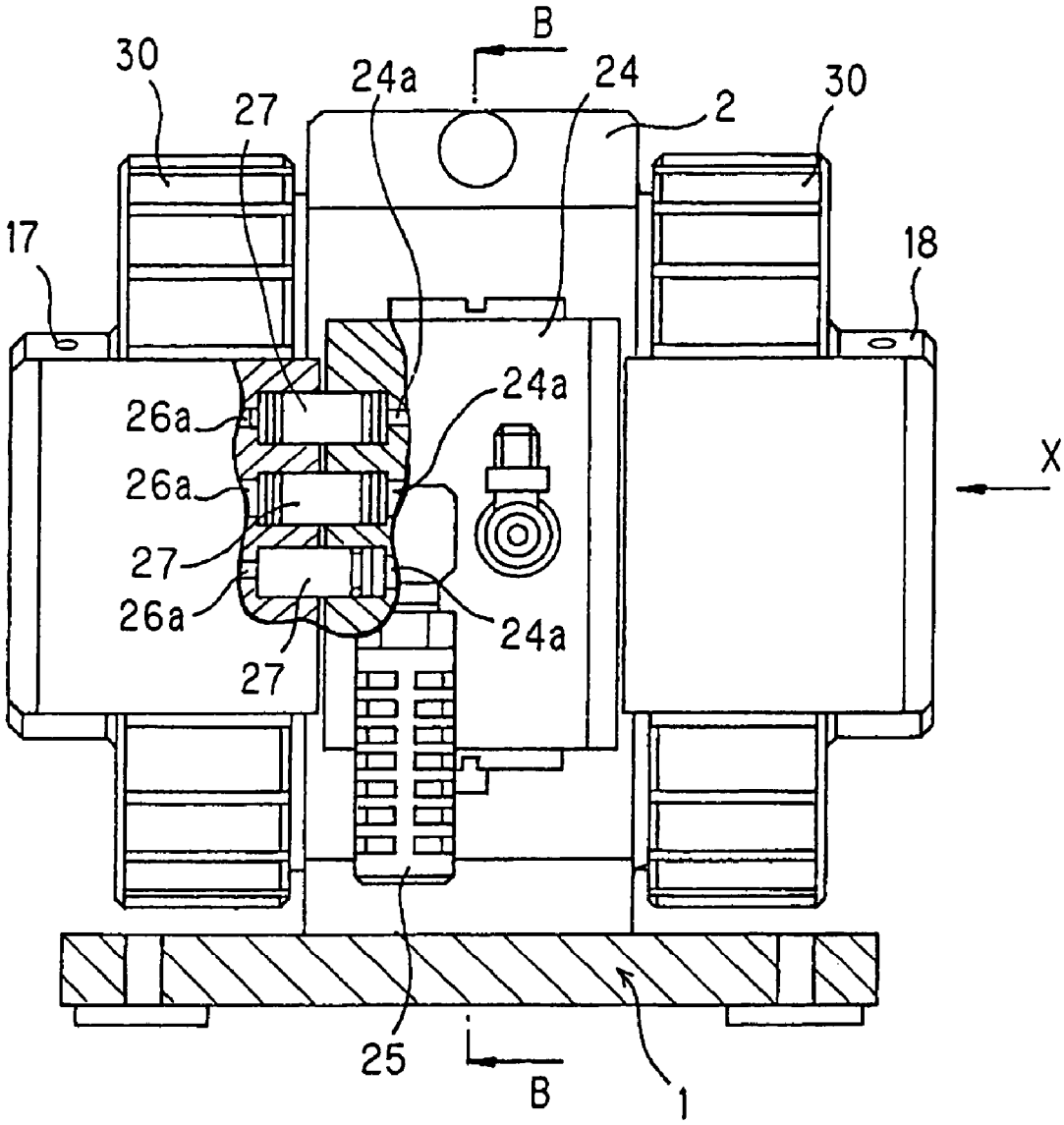
FIG. 3 is a front elevational view, partly in cross section, of the diaphragm pump according to the embodiment of the present invention.

In FIG. 1, reference numeral 1 designates a base plate and 2 designates a main body block. The main body block 2 is secured to the base plate 1 in any appropriate manner and is provided with, as shown in FIG. 2, a supply passage 3 for supplying a fluid and a discharge passage 4 for discharging. Also, a center rod 5 incorporated therein, as shown in FIG. 1, so as to be capable of making a reciprocating motion.

To respective opposite ends of the center rod 5 are attached diaphragms 6 and 7, which are exemplary embodiments of the barrier membranes. In this case, a peripheral portion 6*a*, 7*a* of the diaphragm 6, 7 is clamped by a main ring 30 and an annular wall 33 of a main body block 2, which will be described later in detail.

In the main body block 2, an intake port 8, 9 is arranged in a supply passage 3 and a discharge port 10, 11 is arranged in the discharge passage 4. The intake ports 8 and 9 and the discharge ports 10 and 11 are provided with ball valves 12-15 functioning as check valves for opening and closing those respective ports.

A pilot valve assembly block 17, 18 having a pilot valve 16 integrated therein as one body is disposed in each side of the main body block 2. The configuration and function of the pilot valve 16 are well known and their detailed description will be herein omitted.

A space between the pilot valve assembly block 17, 18 and the main body block 2 is partitioned into a fluid delivering chamber 19, 20 and a driving chamber 21, 22 by the diaphragms 6, 7. The pilot valve assembly block 17, 18 are also used as the driving chamber defining blocks. The supply passage 3 is in communication with the fluid delivering chambers 19, 20 via the intake ports 8, 9, and the fluid delivering chambers 19, 20 is in turn communicating with the discharge passage 4 via the discharge ports 10, 11.

In the main body block 2, a change-over valve assembly block 23 is secured thereto via a bolt 23A as shown in FIG. 2, and this change-over valve assembly block 23 includes a change-over valve 24 for switching the movable directions of the center rod 5 as well as an exhaust valve element 25, both of which are integrated therein as one body. Configurations and functions of the change-over valve 24 and the exhaust valve element 25 are well known and their detailed description will be herein omitted.

Figure 4:
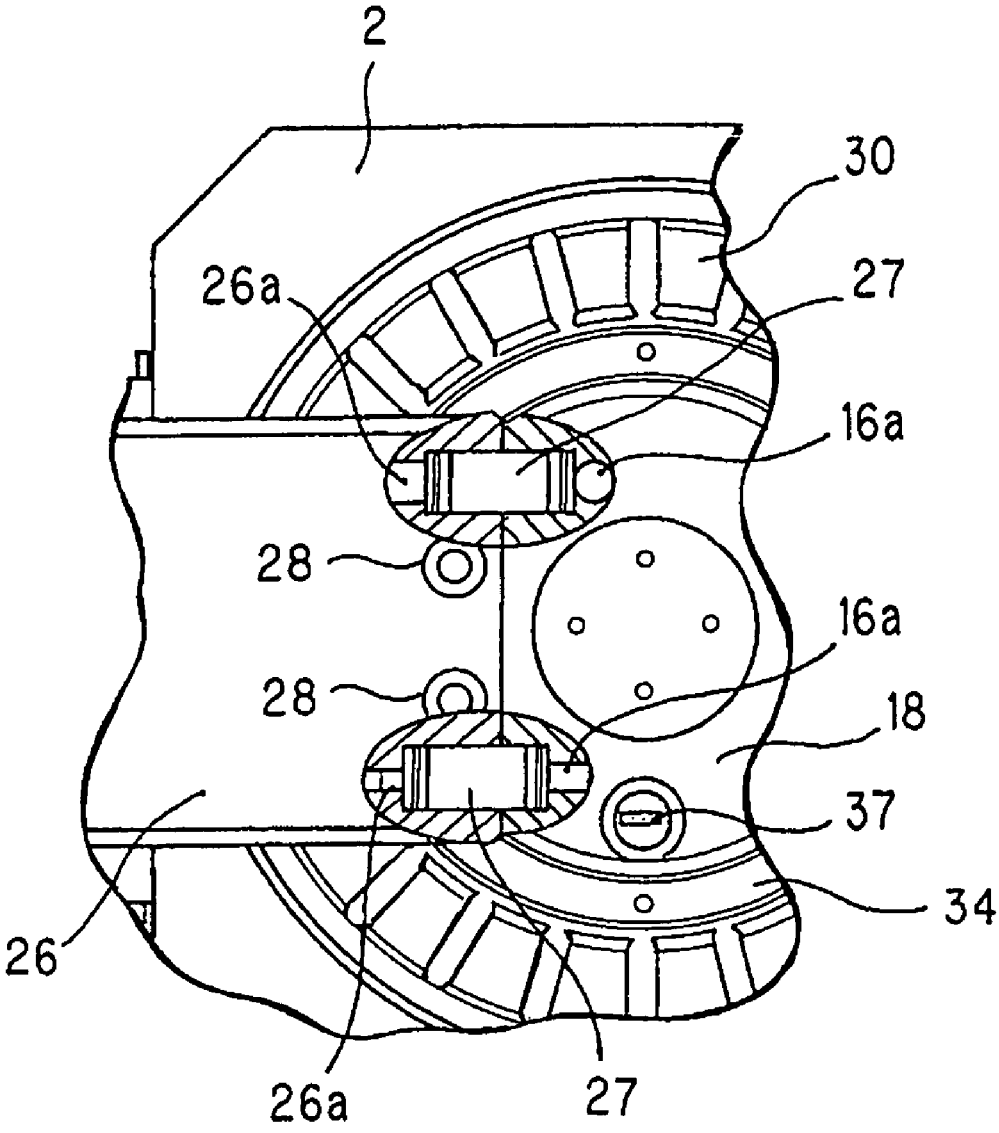
FIG. 4 is a fragmentary view of FIG. 5 partly in section within areas of a piping block.
Figure 5:
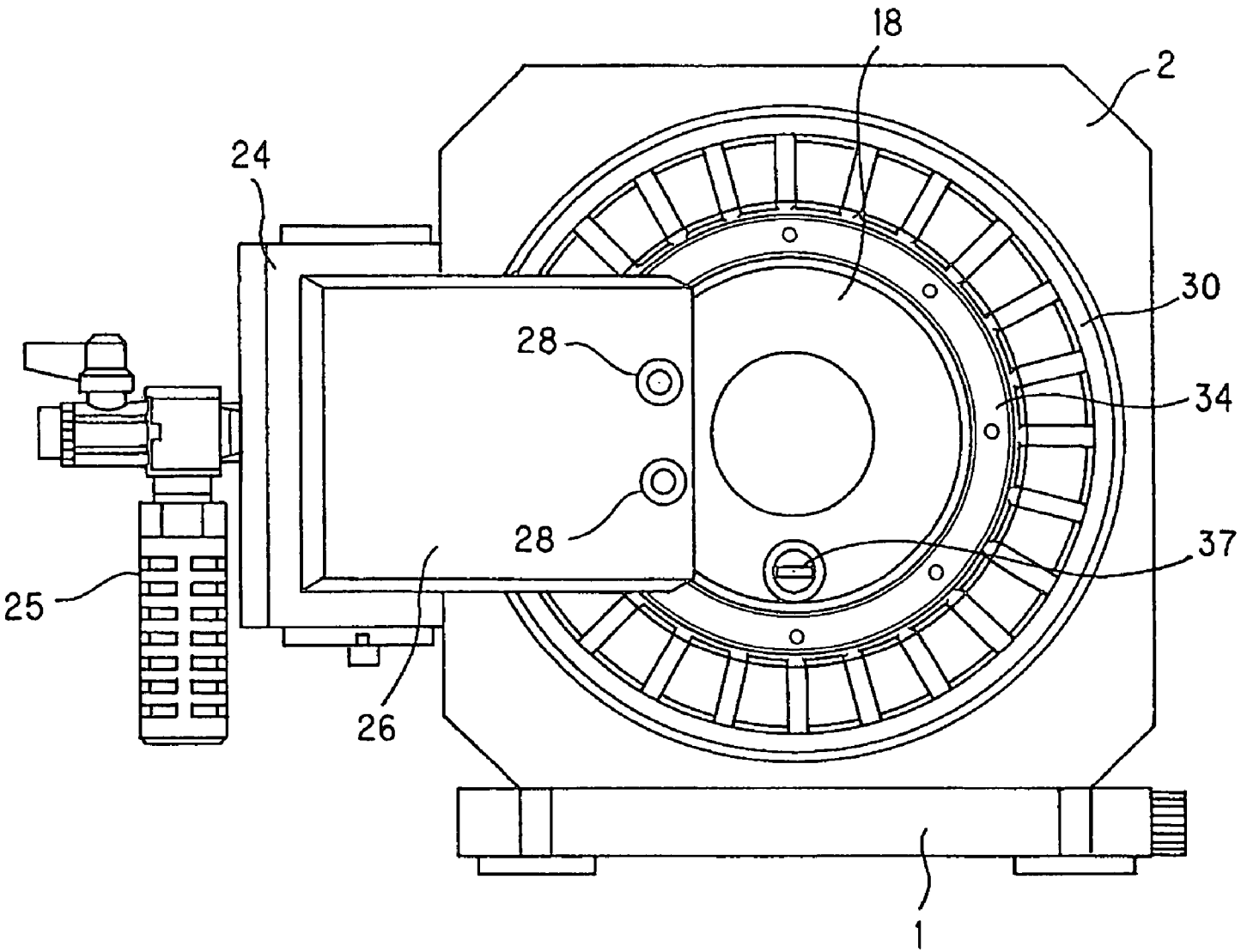
FIG. 5 is a side elevational view of the diaphragm pump according to the embodiment of the present invention, viewed from the direction indicated by the arrow X in FIG. 3.

Each port 24*a* of the change-over valve 24 and each port 16*a* of the pilot valve 16 are interconnected via a connector 27 of a piping block 26 to form a flow channel 26*a*. The piping block 26 is secured to the pilot valve assembly block 17, 18 by a bolt 28 as shown in FIG. 4 and FIG. 5.

The main ring 30 comprises, as shown in FIG. 1, an outer peripheral annular portion 31 and an inner peripheral annular portion 32, which together define an annular space into which an annular wall 33 formed in the main body block section 2 is to be inserted. An annular threaded section 33*a* is formed on the outer surface of the annular wall 33 and an annular threaded section 31*a* is formed on the inner surface of the outer peripheral annular portion 31.

The inner peripheral annular portion 32 has a clamping end portion 32*a* which cooperates with the main body block 2 to clamp the diaphragm 6, 7 in the peripheral portion thereof and also has an internal flange 32*b* projecting radially toward the inner direction.

When the main ring 30 is threadedly engaged and thus attached with the main body block 2, the pilot valve assembly block 17, 18 is pressed against the main body block 2 so as not to drop out from the connection with the main body block 2 by the aid of the main ring 30, but the main ring 30 can be moved rotationally relative to the main body block 2 until it is fastened tightly by the sub ring 34, which will be described later. In this way, the pilot valve assembly 17, 18 is aligned with the main body block 2 along a central axis thereof, and the annular threaded section of the main ring 30 is engaged with the annular threaded section of the main body block 2, such that the main ring 30 can be rotated or held in place along the central axis.

An annular threaded section 17*a*, 18*a* is formed on the outer surface of the pilot valve assembly block 17, 18. The annular threaded section 17*a*, 18*a* is to be threadedly engaged with the sub ring 34 having an annular threaded section 34*a* in the inner surface thereof. When these annular threaded sections are tightly engaged with each other, the pilot assembly block 17, 18 is fixedly secured to the main body block 2 via the sub ring 34.

When the pilot valve assembly block 17, 18 is to be mounted to the main body block 2 such that each port 16*a* of the pilot valve 16 may be connected with each port 24*a* of the change-over valve 24 to form the flow channels 26*a*, firstly the connector 27 of the piping block 26 is coupled to each port 24*a* of the change-over valve 24; secondly the pilot valve assembly block 17, 18 is rotationally moved relative to the main body block 2 so as to connect each port 16*a* of the pilot valve 16 to the connector 27 of the piping block 26; thirdly the sub ring 34 is turned toward the direction for engaging itself via the threads and thus is fastened to the threaded section of the pilot valve assembly block 17, 18; and thereby the pilot valve assembly block 17, 18 comes into contact with the internal flange 32*b*. Through these operations, the pilot valve assembly blocks 17, 18 together with the diaphragms 6, 7 are fixedly secured with the aid of main ring 30 and the sub ring 34. After that, the piping block 26 is fastened and secured to the pilot valve assembly block 17, 18 via a bolt 28.

Figure 6:
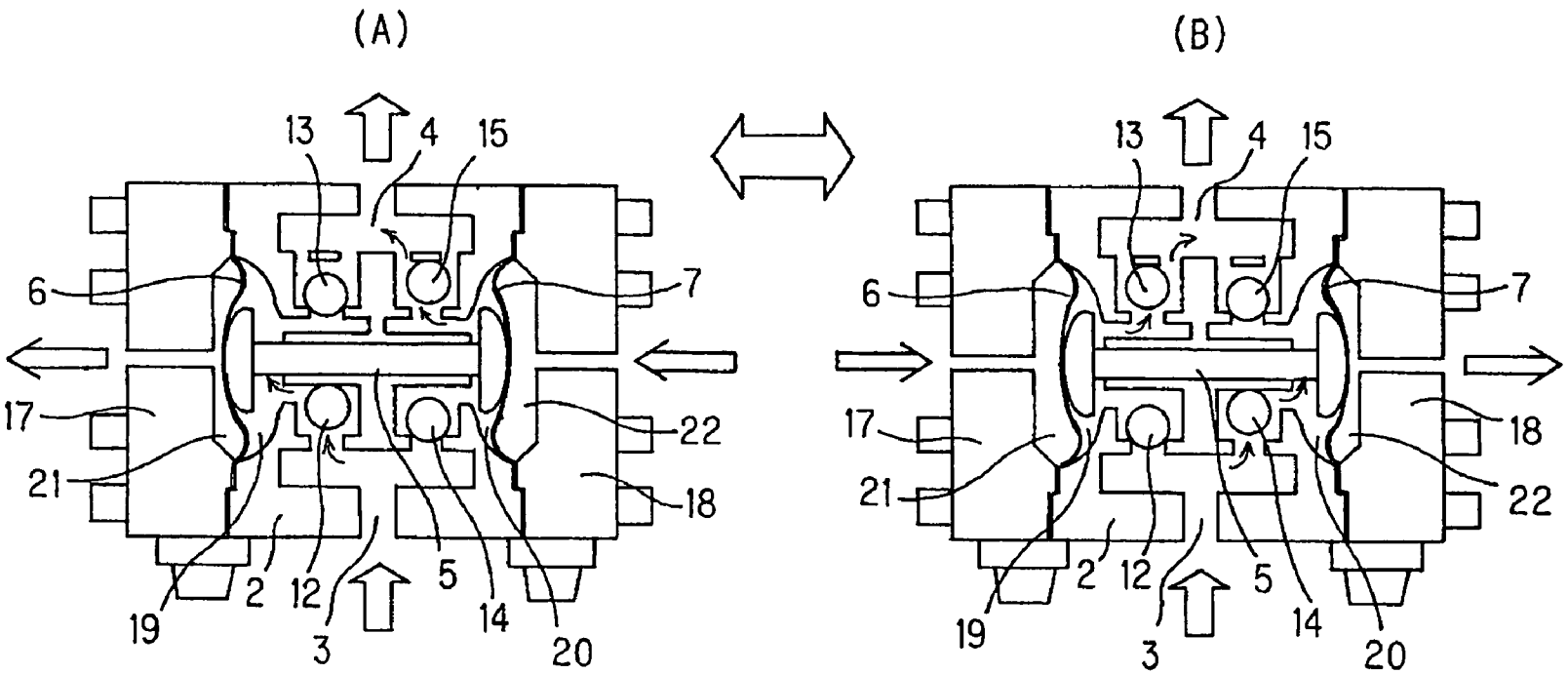
FIG. 6 is a schematic diagram conceptually illustrating an operation of a diaphragm pump according to the embodiment of the present invention, wherein (A) shows a mode in which a center rod is moving toward one direction and (B) shows another mode in which the center rod is moving toward the other direction.

In the diaphragm-type pump provided as an exemplary embodiment of the reciprocating fluid transfer pump having the above-described configuration, when compressed air is supplied into the driving chamber 22 located in the right hand side (the other side), then the center rod 5 is moved toward the left hand side (the one side) as shown in FIG. 6(A), and the expanding and contracting action of the diaphragm 7 pushes out a fluid in the fluid delivering chamber 20 located in the right hand side (the other side) to flow into the discharge passage 4. At the same time, the compressed air in the driving chamber 21 in the left hand side (the one side) is exhausted to the outside, while simultaneously the fluid is auctioned into the fluid delivering chamber 19 in the left hand side (the one side) through the supply passage 3. When the pilot valve 16 detects the contact of the center rod 5, the change-over valve 24 changes over the flow channels 26*a* automatically to cause the center rod 5 to be moved toward the right hand side (the other side) as shown in FIG. 6(B). The expanding and contracting action of the diaphragm causes the compressed air to be supplied into the driving chamber 21 located in the left hand side (the one side) and the fluid in the fluid delivering chamber 19 in the left hand side (the one side) to be pushed out into the discharge passage 4. At the same time with this, the compressed air in the driving chamber 22 in the right hand side (the other side) is exhausted to the outside, while simultaneously the fluid-in-transfer is supplied into the fluid delivering chamber 20 in the right hand side (the other side) through the supply passage 3.

It is to be noted that in FIG. 1, each of reference numerals 35 and 36 designates an O-ring for blocking any leakage from the fluid delivering chamber 19, and reference numeral 37 designates a compressed air release plug.

According to the present invention, because of the configuration as described above, the barrier membrane implemented by, for example, the diaphragm can be mounted between the main body block and the pilot valve assembly block in a simple and easy manner as well as in finely sealed condition without requiring a particularly high level of machining precision for positioning the pilot valve assembly block relative to the main body block.

What is claimed is:

1. A reciprocating fluid transfer pump comprising:

a main body block including a fluid supply passage and a fluid discharge passage;

a center rod inserted in said main body block and being capable of reciprocating movement relative to said main body block;

a barrier membrane attached to an end portion of said center rod, said barrier membrane and said main body block defining a fluid delivering chamber and a driving chamber such that a fluid, once having suctioned into the fluid delivering chamber, is discharged by expanding and contracting said barrier membrane;

a main ring engaged via threads with an annular wall of said main body block, said main ring being movable rotationally relative to said main body block to insert the annular wall of said main body block into an annular space defined between an axially extending outer annular portion of said main ring and an axially extending inner annular portion of said main ring such that a peripheral portion of said barrier membrane is clamped and thus fixedly secured to said main body block; and a pilot valve assembly block fixedly secured to said main body block by engaging said main ring with said main body block, said pilot valve assembly block having a pilot valve integrated therein as one body for detecting reciprocating motion of said center rod; and a sub ring engaged via a thread with a threaded section of said pilot valve assembly block, wherein said main ring includes an internal flange that projects radially inward from the axially extending inner annular portion of said main ring, and said internal flange is clamped between said sub ring and a radially outwardly projecting portion of said pilot valve assembly block such that, by threading said sub ring onto said pilot valve assembly block, an axial force is applied by said sub ring to said main ring to prevent rotational movement thereof.

2. A reciprocating fluid transfer pump in accordance with claim 1, further comprising a change-over valve assembly block having a change-over valve integrated therein as one body for switching movable directions of said center rod, said change-over valve assembly block being fixedly secured to said main body block, wherein said change-over valve assembly block and said pilot valve assembly block are interconnected via a piping block defining flow channels for connecting respective ports of said change-over valve with respective ports of said pilot valve.

3. A reciprocating fluid transfer pump in accordance with claim 2, in which said respective ports are connected to said respective flow channels of said piping block via connectors.

4. A reciprocating fluid transfer pump in accordance with claim 3, in which said piping block is secured fixedly to said main body block via said pilot valve assembly block.

5. A reciprocating fluid transfer pump in accordance with claim 3, further comprising a second barrier membrane attached to a second end portion of said center rod.

6. A reciprocating fluid transfer pump in accordance with claim 1, wherein the axially extending outer annular portion of said main ring is radially spaced from the axially extending inner annular portion of said main ring.

7. A reciprocating fluid transfer pump in accordance with claim 6, wherein the peripheral portion of said barrier membrane is clamped by being directly contacted by said main body block and said main ring.

* * * * *